United States Patent [19]

Ueda

[11] 4,303,026

[45] Dec. 1, 1981

[54] SEAMING METHOD AND APPARATUS FOR GORED PANTY-HOSE

[75] Inventor: Toshiharu Ueda, Yamatotakada, Japan

[73] Assignee: Takatori Machinery Works Ltd., Japan

[21] Appl. No.: 963,266

[22] Filed: Nov. 24, 1978

[51] Int. Cl.[3] ..... D05B 21/00

[52] U.S. Cl. ..... 112/121.15

[58] Field of Search ..... 112/121.15, 121.11, 112/121.12; 2/409; 223/112, 43

[56] References Cited

U.S. PATENT DOCUMENTS

| | | | |
|---|---|---|---|
| 2,697,925 | 12/1954 | Goodman | 2/409 |
| 3,777,681 | 12/1973 | Horita | 112/121.15 |
| 4,133,276 | 1/1979 | Selvi | 112/121.15 |
| 4,188,897 | 2/1980 | Takatori | 112/121.15 |
| 4,188,898 | 2/1980 | Bell, Jr. et al. | 112/121.15 |

*Primary Examiner*—H. Hampton Hunter

*Attorney, Agent, or Firm*—Lerner, David, Littenberg & Samuel

[57] ABSTRACT

A pair of tubular stocking materials nipped by a pair of template units travelling along a circular guide rail are sliced at the center portions thereof to the thigh portions, sliced fringes are exposed outside in a substantially straight form by turning of the template units from each other, one sliced fringe only is seamed to one fringe of a separately fed gore piece on a first sewing machine, and the two sliced fringes are thereafter seamed together on a second sewing machine while concurrently seaming the other sliced fringe to the other fringe of the gore piece, approach of the sliced fringes being carried out under positive path control based on electric detection of the passage. In such a manner, a panty-hose with a gore can be manufactured automatically at enhanced process efficiency.

12 Claims, 36 Drawing Figures

SEAMING METHOD AND APPARATUS FOR GORED PANTY-HOSE

BACKGROUND OF THE INVENTION

The present invention relates to an improved seaming method and apparatus for gored panty-hoses, and more particularly relates to improvement in manufacturing of panty-hoses of a type in which a gore or crotch piece is attached to the thigh portion of a panty-hose.

There is lately a remarkable penetration of panty-hoses into the market of apparels and same are welcomed by many users from the viewpoint of functionability and beauty culture, the panty-hose being made up of a panty portion and a pair of stocking portions formed in one body to each other.

One typical example of the technique for manufacturing such a panty-hose is disclosed in U.S. Pat. No. 3,777,681, in which a pair of tubular stocking materials are seamed together on an automatic apparatus in order to form a panty portion in one body with a pair of stocking portions. Since use of the so-known gore is omitted, this type of panty-hose is in general called as a goreless panty-hose. Despite absence of the gore, relatively large stretchability of the material used for the goreless panty-hose assures appreciable fitness to the body of the user. Thanks to omission of the gore, seaming of the thigh portion of the panty-hose can be quite easily and automatically carried out on a sewing machine.

Despite the rather appreciable fitness to a user's body and easiness in manufacturing, the goreless panty-hose cannot still beautifully meet delicately variating requirements and preferences of consumers of panty-hoses in general. For these reasons, there looms lately a trend to revaluate the delicate fitness of the gored panty-hose to the user's body in spite of its relatively complicated manufacturing process.

Conventional manufacturing of such a gored panty-hose is practiced by highly skilled manual operation since attachment of the gore to the thigh portion of the panty-hose requires complicated seaming procedures. When compared with the goreless panty-hoses, manufacturing of the gored panty-hoses is considerably low in process efficiency and requires greatly increased manual labour, thereby leading to increased manufacturing costs.

SUMMARY OF THE INVENTION

It is one object of the present invention to provide gored panty-hoses at high process efficiently in the manufacturing process.

It is another object of the present invention to provide a system to manufacture of gored panty-hoses in an almost fully automatic manner.

It is a further object of the present invention to enable manufacturing of gored panty-hoses with reduced manufacturing costs.

In accordance with the present invention, a pair of stocking materials are held by nipping by a pair of template units on a template assembly traveling along a prescribed path, the center portions of the stocking materials are sliced to the thigh portion by a cutter device in order to form sliced fringes, the sliced fringes are exposed in a substantially straight form outside the stocking materials by turning of the pair of template assembly from each other, one sliced fringe is guided under path control to the first seaming position while keeping the other sliced fringe outside the seaming position by a suitable guide, the center portion of the one sliced fringe is seamed by a first sewing machine to one fringe of a gore piece separately fed to the first seaming position, the other sliced fringe is guided under path control to the second seaming position while keeping the center portion of the one sliced fringe seamed to the one fringe of the gore piece outside the seaming position by a suitable guide member, both sliced fringes are seamed together by a second sewing machine at the second seaming position while concurrently seaming the center portion of the other sliced fringe to the other fringe of the gore piece.

DESCRIPTION OF PREFERRED EMBODIMENT

Figure 1A:
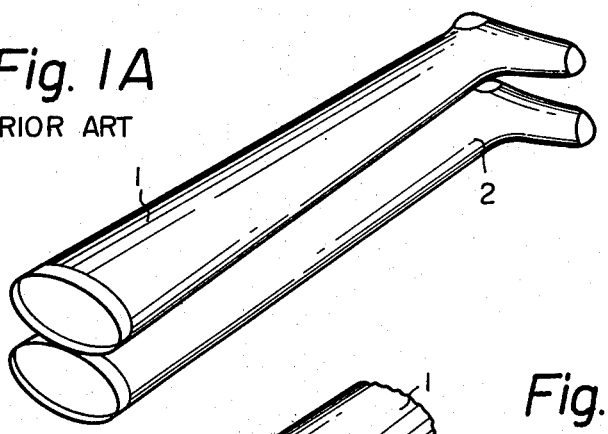
Fig. 1A PRIOR ART
FIGS. 1A through 1D are perspective views showing a typical manufacturing process of the conventional goreless panty-hose.
Figure 1B:
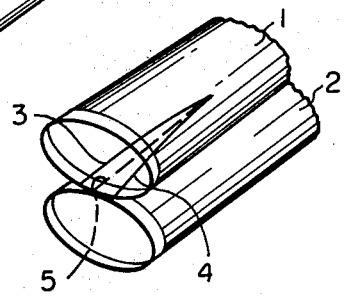
Figure 1C:
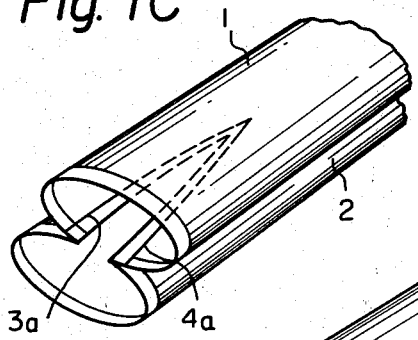

One typical example of the conventional seaming method for goreless panty-hoses is shown in FIGS. 1A through 1D in a simplified illustration. A pair of stocking materials 1 and 2 are put together as shown in FIG. 1A in a superimposed disposition and nipped together along nipping lines 3 and 4 as shown in 1B. While keeping this nipped disposition, the stocking materials 1 and 2 are sliced or cut along a dotted line 5 which runs between the two lines 3 and 4. After the slicing is complete, the open ends of the stocking materials 1 and 2 are spread laterally as shown in FIG. 1C in a direction perpendicular to the slicing line so as to open the sliced portion. Next, seaming is applied to the sliced fringes of the stocking materials 1 and 2 along seaming lines 3*a* and 4*a* which run in parallel to the nipping lines 3 and 4.

In this connection, the seaming lines 3*a* and 4*a* assume a V-shape which extends from the rear side to the front side of a thigh portion of the panty-hose. In order to practice the above-described seaming process on the conventional seaming apparatus, it is necessary to change the V-shaped seaming line into a straight form on the circular path of travel of the mechanical parts nipping the stocking materials 1 and 2 together and expose the seaming line outside the interior of the stocking materials 1 and 2. Seaming is then applied to the exposed portion of the stocking materials 1 and 2 while applying pneumatic suction to the exposed portion.

Figure 1D:
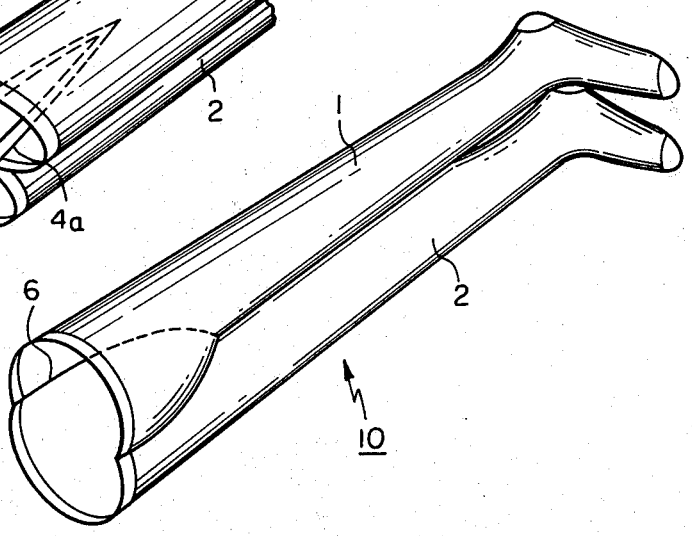

A goreless panty-hose 10 so obtained is shown in FIG. 1D, in which a U-shaped seaming line 6 extends from the back side to the front side of the thigh portion. Thus, the panty-hose 10 is provided with a panty portion which is quite identical in size on both sides of the thigh. Even when appreciably stretchable material is used for the panty-hose, this identity in size tends to result in rather poor fitness of the panty portion to the thigh and its related parts of the user which are in general very much curvelinear. This drawback is further amplified when the panty-hose is worn by a user large in body size or when the user wearing the panty-hose sits since the panty-hose is subjected to extremely increased stretching under such conditions. Violent action of the use further causes excessive stretching of the thigh portion of the panty-hose which often leads to development of breakage of the panty-hose near the seamed portion of its thigh. In addition, the U-shaped seaming line of the goreless panty-hose is located on the center of the thigh of the user under the normal conditions and presence of such a seamed portion often makes the thigh of the user very uncomfortable.

As hereinabove described, the present invention contemplates elimination of the above-described drawbacks inherent with goreless panty-hoses and provision of an automatic seaming system in which gored panty-hoses can be manufactured with enhanced process efficiency.

Figure 2A:
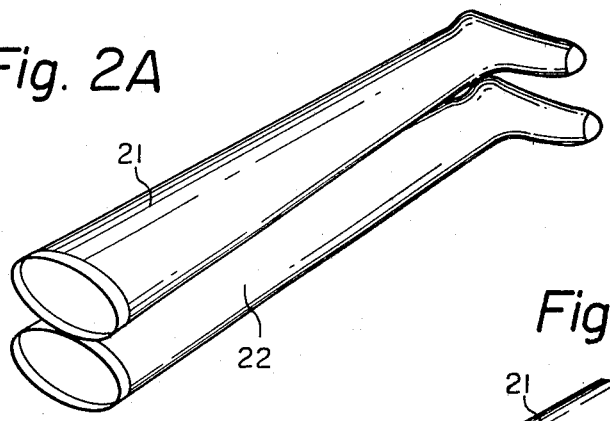
FIGS. 2A through 2F are perspective views showing the principal manufacturing process of a gored panty-hose in accordance with the present invention.
Figure 2B:
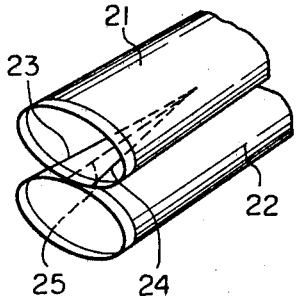

The basic seaming system in accordance with the present invention is shown in FIGS. 2A through 2F. To begin with, a pair of stocking materials 21 and 22 are put together as shown in FIG. 2A in a superimposed disposition. Next, the stocking materials 21 and 22 are nipped together along nipping lines 23 and 24 as hereinafter explained in more detail as shown in FIG. 2B. While keeping this nipped disposition, the stocking materials 21 and 22 are sliced along a dotted line 25 which runs between the two nipping lines 23 and 24 as shown in FIG. 2B to form sliced fringes or seaming edges 21*a* and 22*a* respectively.

Figure 2C:
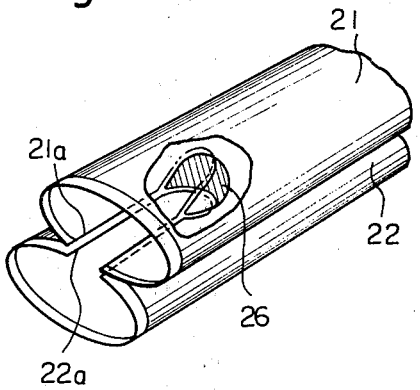
Figure 2D:
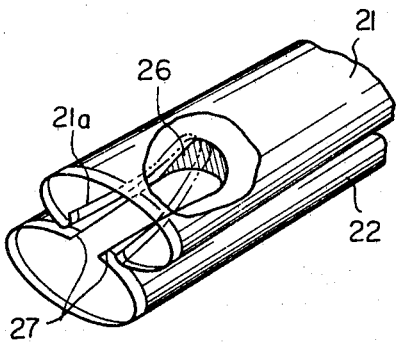
Figure 2E:
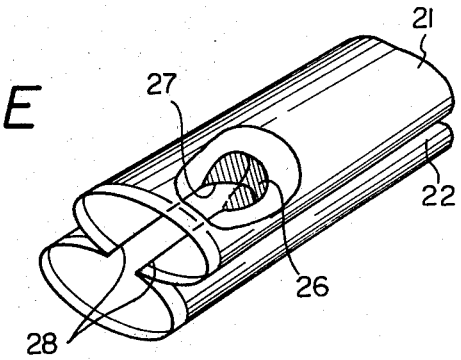
Figure 2F:
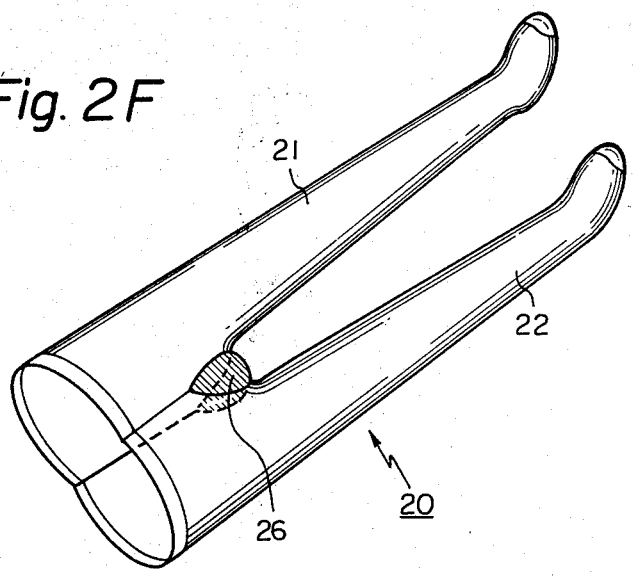

A rhombic gore piece 26 is then placed in position in the thigh opening formed by the slicing as shown in FIG. 2C and seaming is carried out in parallel to the nipping lines 23 and 24 in two stages by two sets of sewing machines. In the first stage, the sliced fringe a seaming edge 22*a* of the lower side stocking material 22 and one fringe of the gore piece 26 are seamed together by the first sewing machine along a seaming line 27 as shown in FIG. 2D. In the second stage, the sliced fringes 21*a*, 22*a* of both stocking materials 21 and 22 are seamed together and, concurrently, the sliced fringe 21*a* of the upper side stocking material 21 and the other fringe of the gore piece 26 are seamed together along a seaming line 28 as shown in FIG. 2E. Thus, a panty-hose 20 such as shown in FIG. 2F is obtained, which is provided with the gore piece 26 attached to its thigh portion.

During the above-described seaming process, the V-shaped seaming line is changed into a straight form on the circular path of travel of the mechanical parts for nipping together the stocking materials 21 and 22, the sliced fringes 21*a* and 22*a* are exposed outside the interior of the stocking materials 21 and 22 and the sliced fringes 21*a* and 22*a* in the exposed disposition are seamed together with the gore piece 26 in the above-described two stages.

Figure 3:
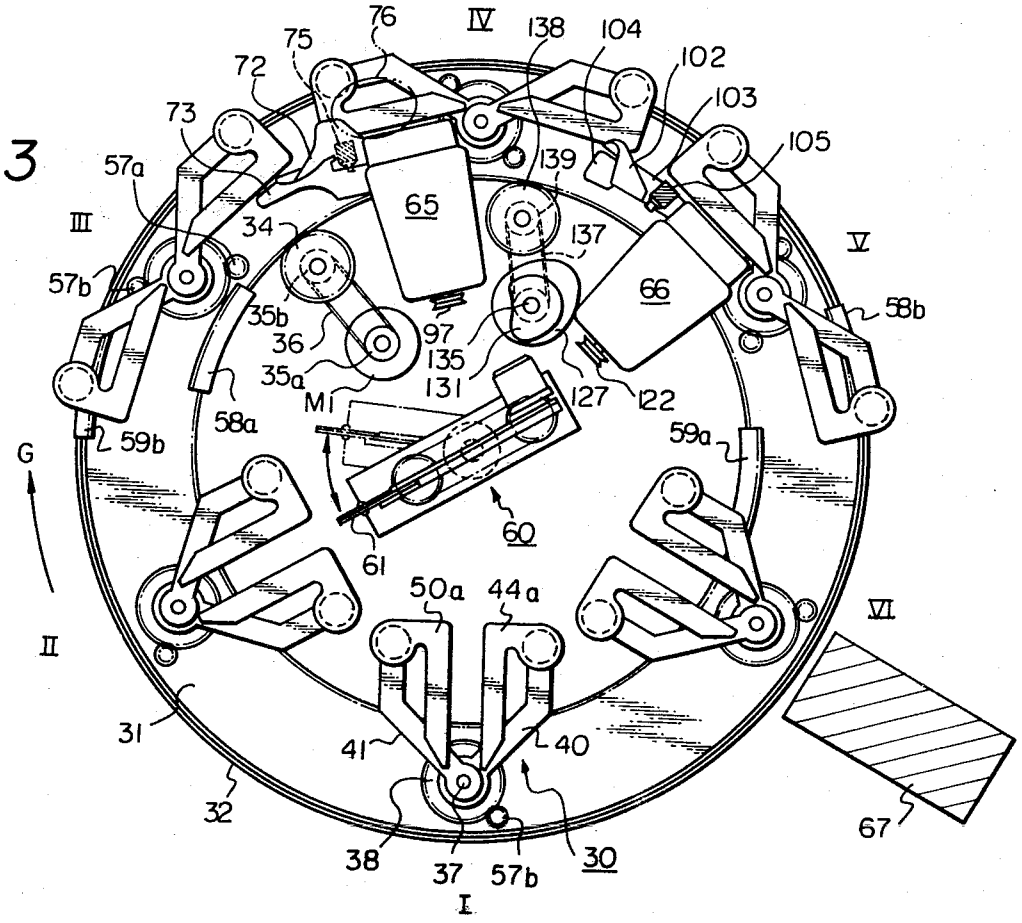
FIG. 3 is a plan view of a preferred embodiment of the seaming apparatus in accordance with the present invention.

The basic embodiment of the seaming apparatus in accordance with the present invention is shown in FIG. 3. which is advantageously used for manufacturing of the above-described gored panty-hose 20.

An annular carrier 31 is arranged for travel along a circular guide rail 32 fixed on the floor and a plurality of template assemblies 30 are mounted on the annular carrier 31 preferably at equal intervals along the path of travel. In the case of the illustrated arrangement, six sets of template assemblies 30 are mounted on the annular carrier 31. Each template assembly 30 is provided with a pair of turntable arms, and the turntable arms each carries three nipping templates as hereinafter explained in more detail.

Figure 4:
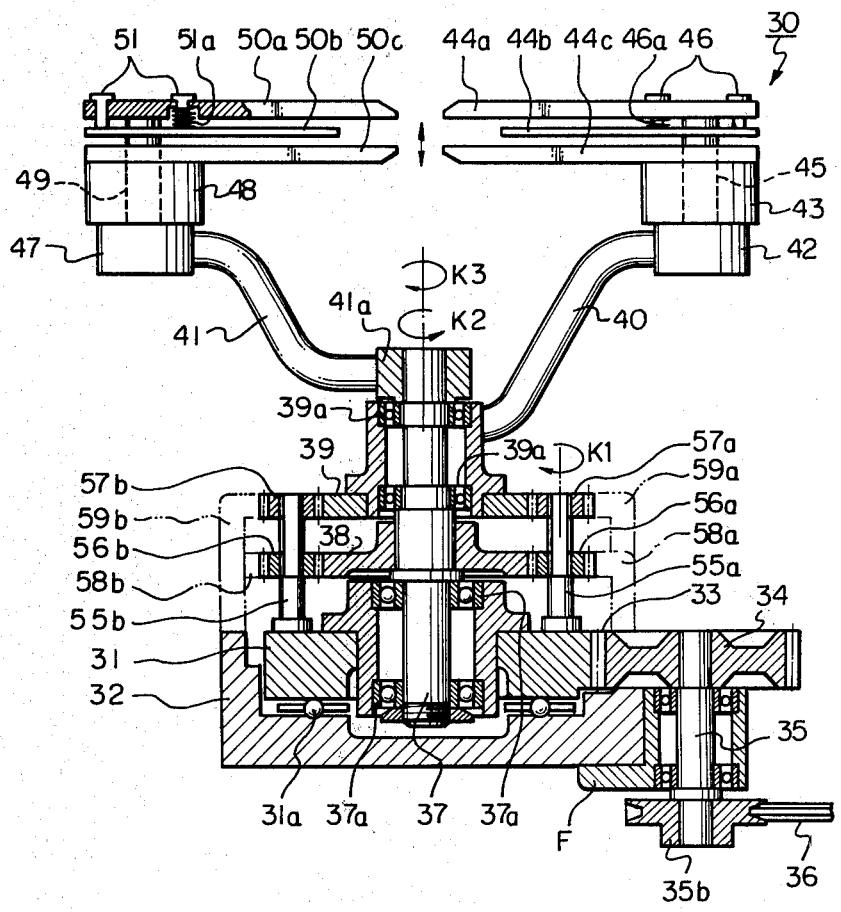
FIG. 4 is a side view partially in section of a template assembly and its related parts at the station III in FIG. 3.

The construction of the template assembly 30 is shown in detail in FIG. 4, in which the guide rail 32 is fixed to the framework F of the apparatus and the annular carrier 31 is mounted on the guide rail 32 via bearings 31*a* for movement along a circular path of travel defined by the guide rail 32. The annular carrier 31 is provided on the inside periphery thereof with a rack 33 which is in meshing engagement with a pinion 34 fixedly mounted on a vertical rotary shaft 35. The rotary shaft 35 further fixedly carries a gear 35*b* which is operationally coupled via a pulley 36 to a gear 35*a* (see FIG. 4). The gear 35*a* is coupled to the output shaft of a drive motor M1 (see FIG. 3) via a suitable reduction gear train (not shown). As the drive motor M1 rotates, the annular carrier 31 is driven for movement in the direction shown by an arrow G in FIG. 3 via the gears 33, 34, 35*a* and 35*b*.

By applying suitable electric control to the operation of the drive motor M1, the travelling speed of the annular carrier 31, i.e. the template assemblies 30, can be freely adjusted in accordance with operational ability of operators. When required, even intermittent movement of the template assemblies 30 can be practical.

A vertical main shaft 37 is rotatably mounted on the carrier 31 via bearings 37*a* and the main shaft 37 fixedly carries a horizontal first gear 38. At a position somewhat above the first gear 38, the main shaft 37 further idly carries a horizontal second gear 39 via bearings 39*a*.

A pair of turnable arms 40 and 41 are carried by the main shaft 37. That is, the first arm 40, i.e. the arm shown on the right side in FIG. 4, is fixedly coupled to the second gear 39, whereas the second arm 41, i.e. the arm shown on the left side in FIG. 4, is fixedly coupled atop the main shaft 37 via a boss 41*a*.

The first arm 40 carries a cylinder 42 fixed to the free end thereof and a solenoid 43 is coupled in one body to the cylinder 42. A lower nipping template 44*c* is fixed to the solenoid 43. A vertical shaft 45 movably inserted into the solenoid 43 likewise fixedly carries an upper nipping template 44*a* which is almost the same in length as the lower nipping template 44*c*. A pair of pins 46 are idly inserted into a slot formed longitudinally in the upper nipping template 44*a* and carry an intermediate nipping plate 44*b* fixed to the lower ends thereof. A compression spring 46*a* is inserted between the upper and intermediate nipping templates 44*a* and 44*b* while winding about one of the pins 46 in order to bias the two templates 44*a* and 44*b* in a prescribedly spaced relationship from each other. The intermediate nipping template 44*b* is smaller in length than the other nipping templates 44*a* and 44*c*. When the solenoid 43 is energized with the above-described construction, the vertical shaft 45 is drawn into the solenoid 43 in order to pull down the upper nipping template 44*a* with the intermediate nipping plate 44*b* as shown with an arrow J in FIG. 4, thereby placing the three nipping templates 44*a* through 44*c* in neat pressure contact to each other. As the solenoid 43 is disenergized, the three nipping templates 44*a* through 44*c* resume the spaced relationship shown in FIG. 4.

In a almost similar fashion, the second arm 41 is provided with a cylinder 47, a solenoid 48, an upper nipping template 50*a*, an intermediate nipping template 50*b*, a lower nipping template 50*c*, a vertical shaft 49, a pair of pins 51 and a compression spring 51*a*, which operate in a similar fashion.

The solenoids 43 and 48 are designed to operate substantially synchronously.

On one side of the main shaft 37, a vertical auxiliary shaft 55*a* is fixedly mounted atop the annular carrier 31 and idly carries upper and lower gears 57*a* and 56*a*. The upper gear 57*a* is in meshing engagement with the second gear 39 on the main shaft 37 and the lower gear 56*a* is in meshing engagement with the first gear 38 on the main shaft 37. On the other opposite side of the main shaft 37, a vertical auxiliary shaft 55*b* is fixedly mounted atop the annular carrier 31 and idly carries upper and lower gear 57*b* and 56*b*. The upper gear 57*b* is in meshing engagement with the second gear 39 on the main shaft 37 and the lower gear 56*b* is in meshing engagement with the first gear 38 on the main shaft 37.

A pair of inside upper and lower gears 59*a* and 58*a* are fixedly mounted atop the guide rail 32 in such an arrangement that, as the carrier 31 travels, the inside upper gear 59*a* comes into meshing engagement with the upper gear 57*a* on the auxiliary shaft 55*a* and the inside lower gear 58*a* comes into meshing engagement with the lower gear 56*a* on the auxiliary shaft 55*a*. Likewise, a pair of outside upper and lower gears 59*b* and 58*b* are fixedly mounted atop the guide rail 32 in such an arrangement that the outside upper gear 59*b* comes into meshing engagement with the upper gear 57*b* on the auxiliary shaft 55*b* and the outside lower gear 58*b* comes into meshing engagement with the lower gear 56*b* on the auxiliary shaft 55*b*.

As the carrier 31 travels along the guide rail 32, the inside lower gear 58*a* on the guide rail 32 engages with the lower gear 56*a* on the carrier 31 and the latter gear 36*a* rotates in the direction shown by arrow K1 in FIG. 4(i.e. clockwise as shown in FIG. 3). Thereupon, the first gear 38 fixed on the main shaft 37 rotates in the opposite direction shown by arrow K2 FIG. 4 due to the meshing engagement with the lower gear 56*a*. Since the first gear 38 is fixed to the main shaft 37, this rotation is followed by a similar rotation and turning of the main shaft 37, the second arm 41 and the associated nipping templates 50*a* through 50*c* (i.e., arm 41 rotates in a counterclockwise direction as shown in FIG. 3). Concurrently with this process, the outside upper gear 59*b* on the guide rail 32 engages with the upper gear 57*b* on the carrier 31 for rotation and, thereupon the second gear 39 idly inserted over the main shaft 37 rotates in the direction shown by arrow K3 in FIG. 4 due to the meshing engagement with the upper gear 57*b*. As is apparent, the directions K2 and K3 are opposite to each other. This rotation of the second gear 39 is followed by similar turning of the first arm 40 and the associated nipping templates 44*a* through 44*c* (i.e., arm 40 rotates in a clockwise direction as shown in FIG. 3).

As the carrier 31 further travels along the guide rail 32 and the seaming operation has been completed, the upper gear 57*a* on the carrier 31 comes into engagement with the inside upper gear 59*a* on the guide rail 32 and, concurrently, the lower gear 56*b* on the carrier 31 comes into engagement with the outside lower gear 58*b* on the guide rail 32. Then the first arm 40 and its associated nipping templates 44*a* through 44*c* turn in the direction K2 (as shown in FIG. 4) whereas the second arm 41 and its associated nipping templates 50*a* through 50*c* turn in the direction K3 (as shown in FIG. 4), both in order to resume the initial disposition.

In the case of the illustrated embodiment, six operational stations I through VI are provided along the circular path of travel of the template assemblies 30 as shown in FIG. 3.

Figure 5:
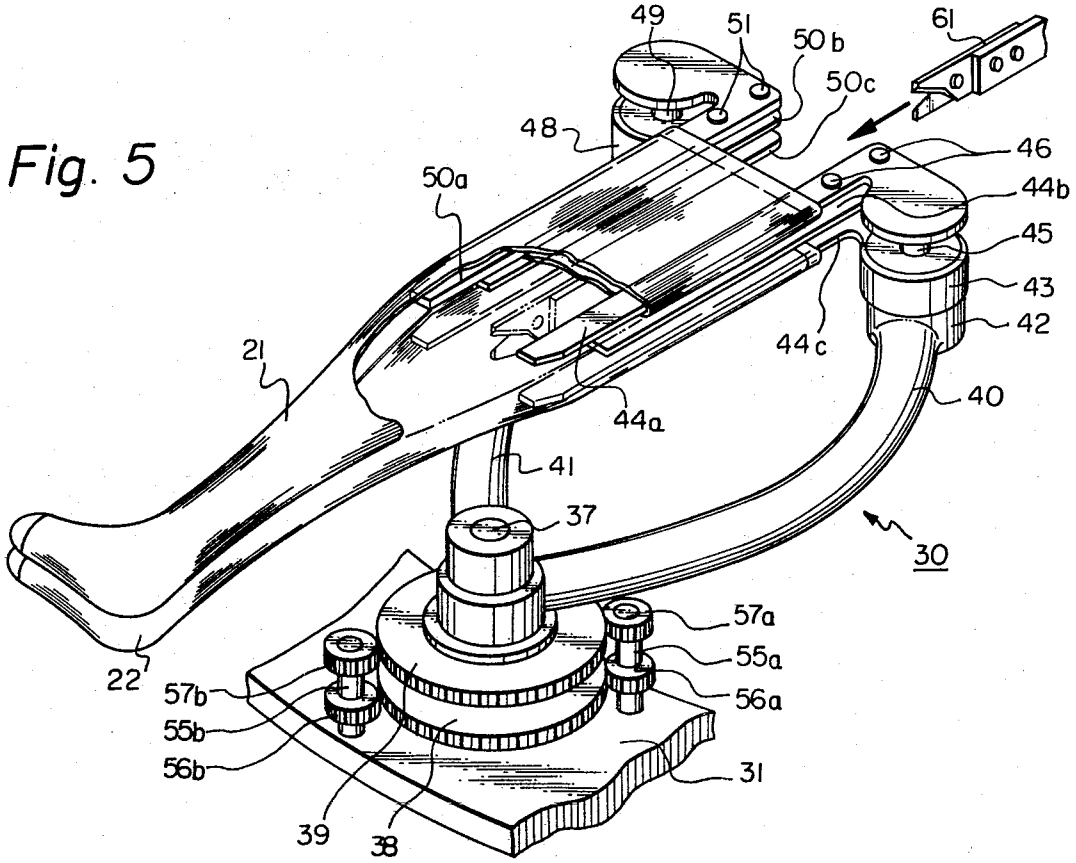
FIG. 5 is a partial perspective view of the template assembly to which a pair of stocking materials are set.

At the first station I, stocking materials are set onto the template assembly 30 and, therefore, this station is referred to as the "setting station". On this setting station I, the stocking materials 21 and 22 are manually set onto the nipping templates 50*a* through 50*c* and 44*a* through 44*c* as shown in FIG. 5. That is, one stocking material 21 is inserted astridingly over the upper nipping templates 44*a* and 50*a* and the other stocking material 22 is inserted astridingly over the lower nipping templates 44*c* and 50*c*. After the setting is complete, the solenoid 43 and 48 are energized in order to bring each of the three nipping templates into pressure contact with each other. Thus, the thigh portions of both stocking materials 21 and 22 are closely superimposed to each other.

As the template assembly 30 is registered at the second station by further travel of the carrier 31, the stocking materials 21 and 22 are sliced. Therefore, this station is referred to as the "slicing station". In this slicing station II, a cutter device 60 is energized so that its cutter 61 advances into the space between the two associated arms 40 and 41 of the template unit 30 in order to slice the stocking materials 21 and 27 along the dotted line 25 shown in FIG. 2B.

After the slicing is complete, the template assembly 30 travels towards the third station III and, during this travel, the gears on the carrier 31 come into engagement with corresponding gears on the guide rail 32 so that the two template units open in order to spread the open ends of the stocking materials 21 and 22. Thus, at the third station III, the sliced fringes 21*a* and 22*a* of the stocking materials 21 and 22 are exposed outside while assuming an arched curve.

With the sliced fringes 21*a* and 22*a* of the stocking materials 21 and 22 assuming the above-described arched curve, the template assembly 30 arrives at the fourth station IV whereat the first seaming is carried out. Therefore, this fourth station IV is referred to as the "first seaming station". As the template assembly 30 passes through this first seaming station 17, the arched sliced fringes or seaming edges 21*a* and 22*a* of the stocking materials 21 and 22 travel in front of a sewing machine 65 and the upper sliced fringe 21*a* is folded upwardly so that the lower sliced fringe 22*a* only is guided to the sewing position on the sewing machine 65. During this process, the gore piece 26 is placed in position and the seaming line 27 is formed on the stocking materials 21 and 22 as shown in FIG. 2D.

The second seaming is carried out on the fifth station V and, therefore, this station is referred to as the "second seaming station". A second sewing machine 66 is arranged at the second seaming station V and, as the sliced fringes 21*a* and 22*a* of the stocking materials travel in front of the second sewing machine 66, the upper and lower sliced fringes 21*a* and 22*a* are seamed together. During this process, the remaining fringe of the gore piece 26 is seamed to the upper sliced fringe 21*a* of the stocking material 21 in order to form the seaming line 28 shown in FIG. 2E.

During the travel of the template assembly 30 from the second slicing station V to the sixth station, the gears on the carrier 31 come into meshing engagement with corresponding gears on the guide rail 32 and the associated template units close towards each other in order to resume the initial disposition as at the stations I and II. As the solenoids 43 and 48 are deenergized, each of three cooperating nipping templates are set free from the mutual pressure contact in order to cancel nipping on the panty-hose and the panty-hose is removed from the template assembly 30 by a stripper mechanism 67. By this removal of the completed panty-hose, the template assembly 30 completes its one cycle operation and returns to the first setting station I for the next cycle operation.

As for details of the mechanical arrangements and operations at the stations I through III and VI, reference should be made to U.S. Pat. No. 3,777,681. The following descriptions are focussed mainly upon those at the stations IV and V whereat the first and second seaming operations are carried out.

Figure 6:
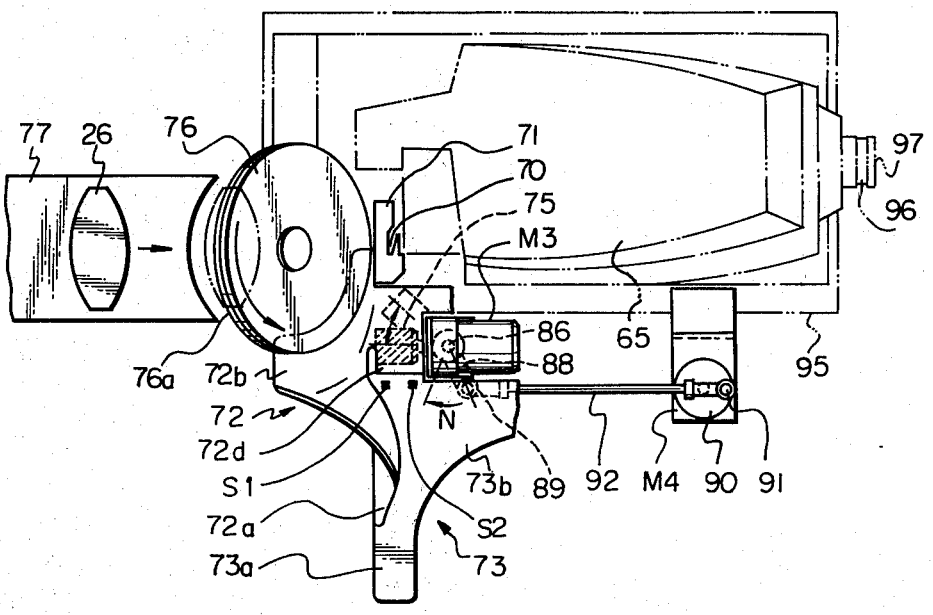
FIG. 6 is a partial plan view of the first sewing machine and its related parts at the station IV in FIG. 3.
Figure 7:
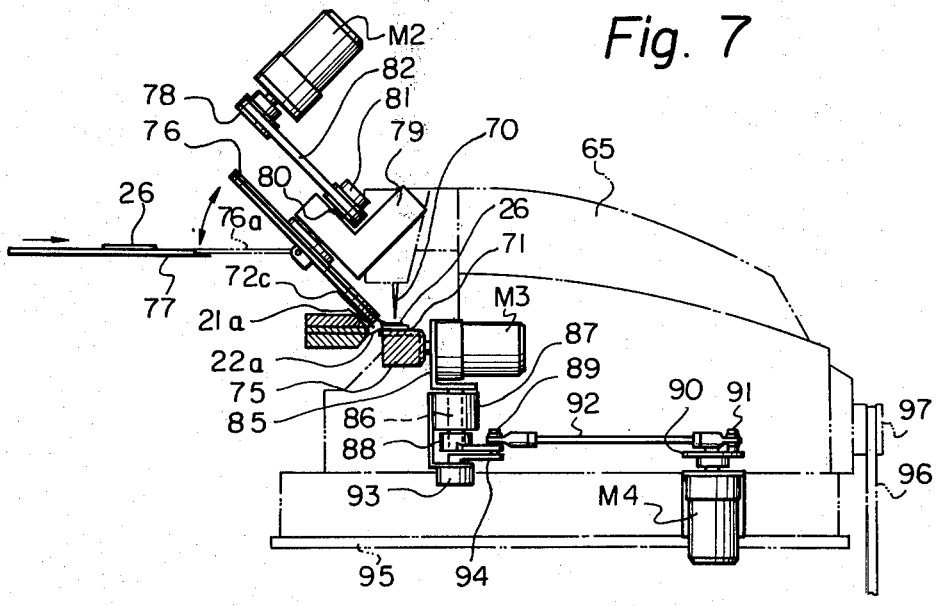
FIG. 7 is a side view of the first sewing machine and its related parts shown in FIG. 6.
Figure 8:
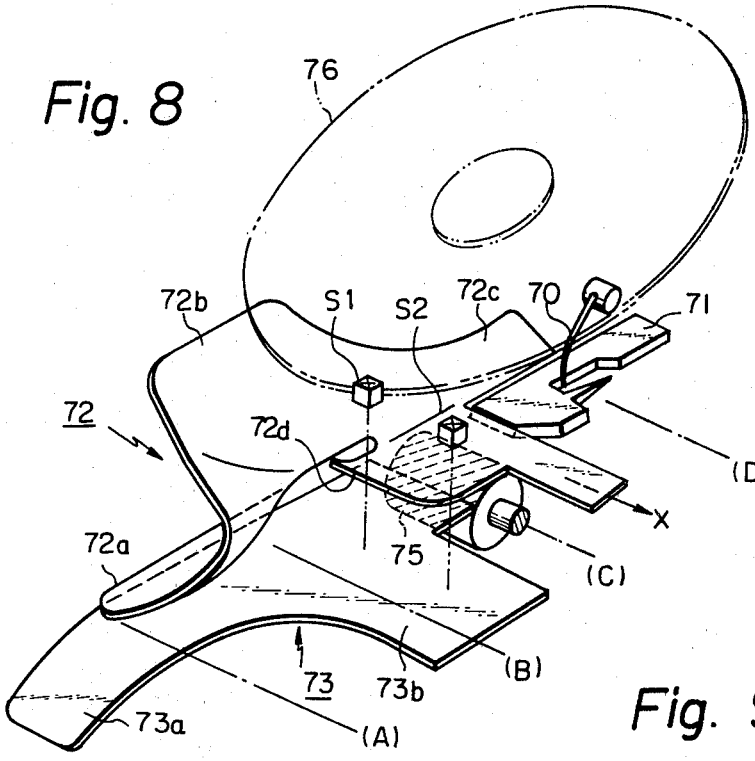
FIG. 8 is an enlarged partial perspective view of the first sewing machine and its related parts.

The mechanical arrangement at the first seaming station IV is shown in detail in FIGS. 6 through 8, in which formation of the seaming line 27 by the first sewing machine 65 is carried out. The first sewing machine 65 is provided with a sewing needle 70 and a needle plate 71. At a position upstream of the needle plate 71, a pair of guide plates 72 and 73 are arranged in a superimposed relationship to each other so that the upper sliced fringe 21*a* of the stocking material 21 is folded upwardly and the lower sliced fringe 22*a* only should be brought to the sewing position of the first sewing machine 65.

The upper guide plate 72 includes a front guide portion 72*a*, an upwardly curved larger guide portion 72*b* extending integrally of the front guide portion 72*a*, an upwardly curved smaller guide portion 72*c* formed integrally and downstreamly of the larger guide portion 72*b*, and a rear guide portion 72*d* extending integrally of the lower end of the larger guide portion 72*b*. A roller 75 is arranged beneath the rear guide portion 72*d* in surface contact therewith. The lower guide plate 73 includes a front guide portion 73*a* which is located below the front guide portion 72*a* and extends beyond the upstream end of the front guide portion 72*a*, and a rear guide portion 73*b* which extends downstreamly and integrally of the front guide portion 73*a* and whose downstream edge confronts the above-described roller 75.

A supply mechanism for the gore piece 26 includes a disc 76 whose degree of inclination is equal to those of the guide portions 72*b* and 72*c* of the upper guide plate 72 and whose periphery is in local contact with the guide portions 72*b* and 72*c*. This disc 76 is made up of two thin disc components superposed to each other as shown in FIG. 7 and the lower half 76*a* of the under side disc component is designed to be openable. When the above-described lower half 76*a* is in an open state as shown with phantom lines in FIG. 7, same engages with the confronting edge of a supply table 77 for the gore piece 26 for reception of the gore piece 26. Upon receipt of the gore piece 26, the lower half 76*a* resumes the closed state in order to nip gore piece 26 between the two disc components.

The disc 76 is fixed at the center thereof to a rotary shaft 80 carried by a fixed bracket 79. This shaft 80 further fixedly carries a driven pully 81 which is operationally coupled, via a belt 82, to a drive pully 78 fixed on the output shaft of a drive motor M2 secured to the framework of the apparatus. Being driven by the drive motor M2, the disc 76 rotates counterclockwise as shown in FIG. 6. At a speed equal to the travelling speed of the carrier 31, i.e. the passing speed of the template assembly 30 in front of the first sewing machine 65. The drive motor M2 is electrically controlled so that the disc 76 ceases its rotation after one complete rotation.

The above-described roller 75 is fixedly mounted on the output shaft of a rotation control motor M3 mounted to an L-shaped bracket 85.

A vertical shaft 86 is rotatably carried by a fixed bracket 87 and fixedly supports the above-described L-shaped bracket 85 at the top thereof. A lever 88 is fixed to the lower end of the vertical shaft 86. A pin 89 is fixed to the other end of the lever 88 and is in engagement with another lever 94 of a variable resistor 93 which governs the operation of the above-described rotation control motor M3 via change in electric voltage. A reversible motor M4 is fixed on the framework of the apparatus and a rotary disc 90 is fixed to the output shaft of this reversible motor M4. A pin 91 is fixed to a point on the peripheral portion of the rotary disc 90. The pin 89 on the lever 88 and the pin 91 on the rotary disc 90 are coupled to each other via an intermediate universal joint 92.

A pair of sensors S1 and S2 are arranged at positions upstream of the roller 75 in order to detect passage through the inlet terminal of the first seaming station IV of the lower sliced fringe 22*a* of the stocking materials 22 nipped by the template assembly 30. As passage of the sliced fringe 22*a* is detected by the one sensor S1 which thereupon passes a corresponding electric signal to the reversible motor M4, the motor M4 is driven for rotation in the positive direction. On the other hand, when passage of the sliced fringe 22*a* is detected by the other sensor S2 which thereupon passes a corresponding electric signal to the reversible motor M4, the motor M4 is driven for rotation into the negative direction which is opposite to the above-described positive direction. The rotation of the reversible motor M4 causes corresponding swing of the levers 88 and 94 in directions shown by an arrow N in FIG. 6 via the disc 90 and the universal joint 92. This swing of the levers 88 and 94 varies the angular relationship of the roller 75 with respect to the passing course of the sliced fringe 22*a* and controls the rotation of the motor M3. The first sewing machine 65 is arranged on a fixed base 95 and operates the sewing needle 70 while being driven by a motor (not shown) via a pulley 97 and a belt 96.

Figure 9:
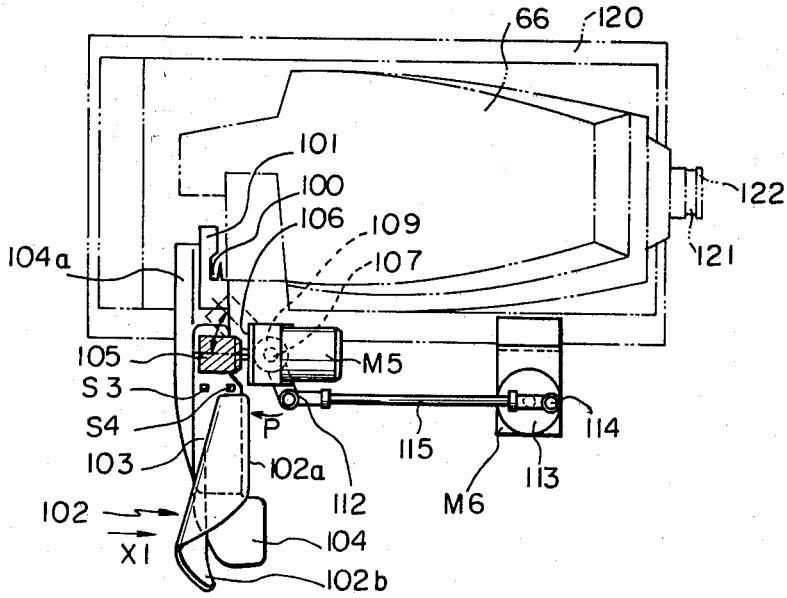
FIG. 9 is a partial plan view of the second sewing machine and its related parts at the station V in FIG. 3.
Figure 10:
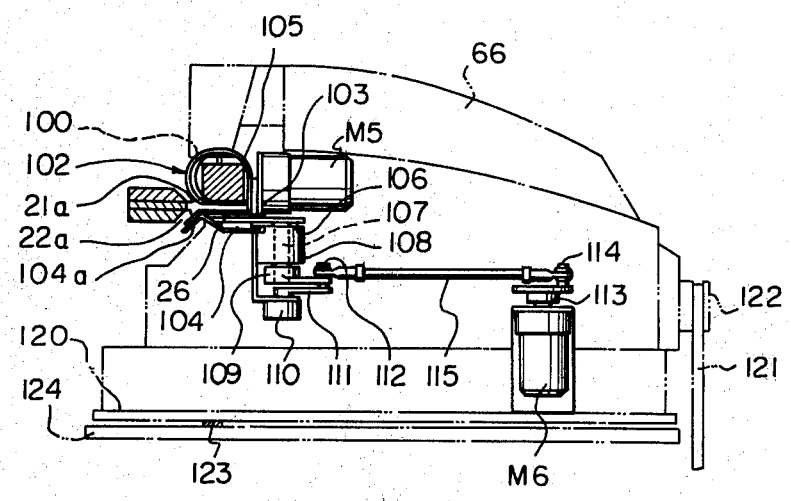
FIG. 10 is a side view of the second sewing machine and its related parts shown in FIG. 9.

The seaming operation carried out at the second station V shall be hereinafter explained in detail with reference to FIGS. 9 through 11, in which the second sewing machine 66 is provided with a sewing needle 100 and a needle plate 101. At a position somewhat upstream of the needle plate 101, there is arranged an upper guide plate 102 which folds back the upwardly folded upper sliced fringe 21*a* of the stocking material 21 to the horizontal disposition and downwardly folds the gore piece 26 seamed at its one fringe to the lower sliced fringe 22*a* of the stocking material 22. This upper guide plate 102 is accompanied by an intermediate guide plate 103 fixed at a right angle to the vertical guide portion of the upper guide plate 102. This intermediate guide plate 103 guides the horizontally folded back upper sliced fringe 21*a* of the stocking material 21 to the seaming position on the second sewing machine 66. A lower guide plate 104 is fixed at a right angle to the vertical guide portion of the upper guide plate 102 at a position somewhat below the intermediate guide plate 103 in order to guide the lower sliced fringe 22*a* of the stocking material 22 and the non-seamed fringe of the gore piece 26 to the seaming position on the second sewing machine 66.

The upper guide plate 102 includes a vertical guide portion 102*a* to which the intermediate and lower guide plates 103 and 104 are to be fixed, and a curved guide portion 102*b* which extends forwardly and integrally of the vertical guide portion 102*a*. The intermediate guide plate 103 is in surface contact at the downstream end portion thereof with a rotary roller 105. The lower guide plate 104 has a downwardly bent guide portion 104*a* arranged in succession to the needle plate 101.

The roller 105 is the same in function to the roller 75 used for the first sewing machine 65 and is fixedly mounted to the output shaft of a rotation control motor M5 carried by an L-shaped bracket 106. A vertical shaft 107 is rotatably carried by a fixed bracket 108. The L-shaped bracket 106 is fixed atop this vertical shaft 107 and a lever 109 is fixed at one end thereof to the bottom end of the vertical shaft 107. A pin 112 is fixed to the other end of the lever 109 and engages with a lever 111 of a variable resistor 110 which governs the operation of the motor M5 via change in voltage. A rotary disk 113 is fixed to the output shaft of a reversible motor M6 and fixedly carries a pin 114 at the peripheral portion thereof. This pin 114 is operationally coupled to the above-described pin 112 on the lever 111 via a universal joint 115. A pair of sensors S3 and S4 are arranged at positions upstream of the roller 105 and are electrically connected to the reversible motor M6. The sensors S3 and S4 detect passage of the sliced fringe 21*a* of the stocking material 21 and pass corresponding electric signal to the reversible motor M6. Rotation of the reversible motor M6 induces, via the universal joint 115, corresponding swing of the levers 109 and 111 into directions shown by an arrow P in FIG. 9 and the angular posture of the roller 105 is changed with respect to the path of travel of the sliced fringe 21*a* through the second seaming station V.

At the second seaming station V, the seaming line 28 is formed by the second sewing machine 66 which is arranged on a base 120 and operates its sewing needle 100 while being driven by a motor (not shown) via a belt 121 and a pulley 122. The above-described base 120 is turnably mounted on a seat 124 via a shaft 123 which is arranged in alignment with the sewing needle 100 (see FIG. 12).

Figure 12:
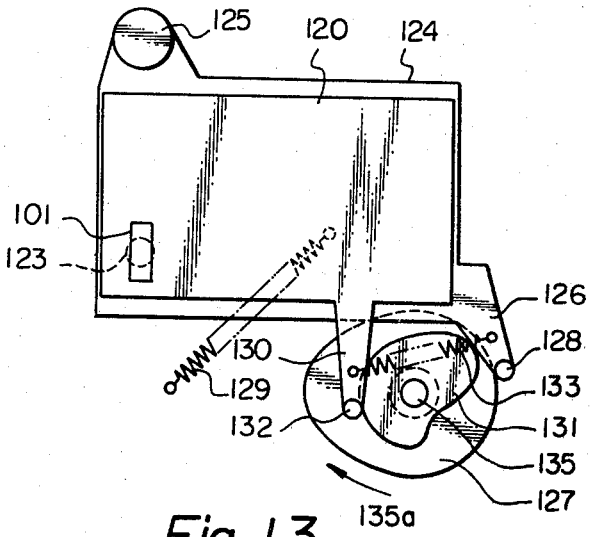
Figure 13:
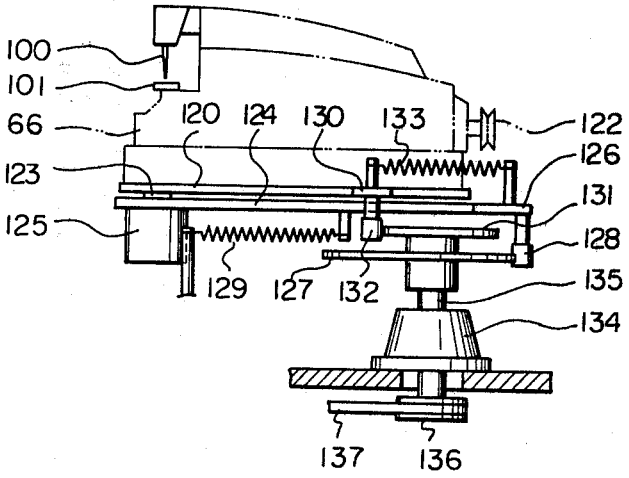

As shown in FIGS. 12 and 13, the seat 124 is turnably supported at one end thereof by a bracket 125 and provided with a rearwardly projecting arm 126. The free end of this arm 126 carries a cam follower roller 128 which is kept in resilient pressure contact with a cam 127 by a tension spring 129 interposed between the seat 124 and a fixed point on the framework of the apparatus. The base 120 is also provided with a rearwardly projecting arm 130. The free end of this arm 130 carries a cam follower roller 132 which is kept in resilient pressure contact with a cam 131 by a tension spring 133 interposed between the two arms 126 and 130.

The two cams 127 and 131 are vertically spaced from each other and fixedly mounted to a common rotary cam shaft 135, the shaft 135 being carried by a bracket 134. The lower end of the shaft 135 fixedly carries a pully 136 which is operationally coupled, via a belt 137, to a pulley 139. The pulley 139 is formed in one body with a gear 138 which meshes with the rack 33 of the carrier 31. Thus, travel of the carrier 31 along the guide rail 32 causes rotation of the cam shaft 135 via the gear 138. Upon turning of the cam shaft 135, the cams 127 and 131 rotate in a direction shown with the arrow 135*a* in FIG. 12. The arrangement is so designed that the cams 127 and 131 complete one cycle of rotation as the template assembly 30 arrives at the second seaming station V and the seaming line 28 is formed on the sliced fringes 21*a* and 22*a* of the stocking materials 21 and 22 by the second sewing machine 66.

Figure 14:
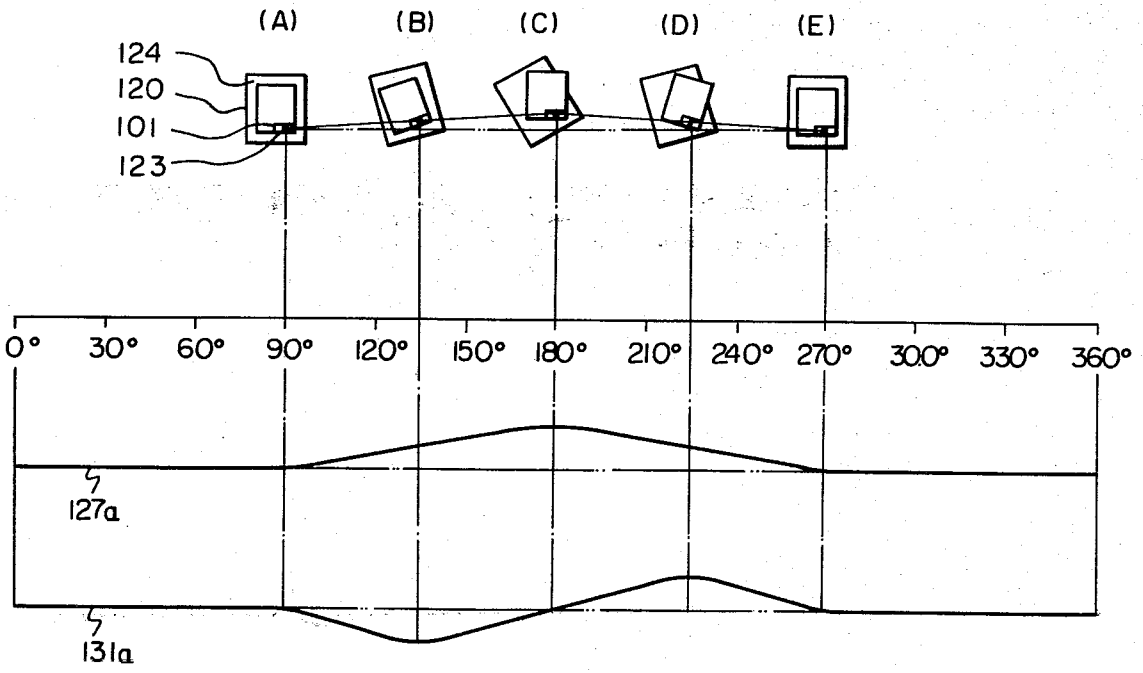
FIG. 14 is a schematic cam diagram showing the cam loci for the cams for swinging the base and the seat shown in FIGS. 12 and 13, and also showing the relative base and seat positions.

One complete rotation of the lower cam 127 gives a cam locus 127*a* shown in FIG. 14 and the roller 128 follows this cam locus 127*a* so that the seat 124 swings about the bracket 125 from the disposition A to the disposition E in FIG. 14. Likewise, one complete rotation of the upper cam 131 gives a cam locus 131*a* shown in FIG. 14 and the roller 132 follows this cam locus 131*a* so that the base 120 swings about the shaft 123 from the disposition A to the disposition E in FIG. 14. This swing of the base 120 is different from that of the seat 124.

The seaming method in accordance with the present invention shall hereinafter be again explained in more detail with caution being focussed particularly upon the first and second seaming operations.

As described already, the operator stands at the setting position in order to set the stocking materials 21 and 22 into the template assembly 30. That is, the one stocking material 21 is inserted over the upper nipping templates 44*a* and 50*a* whereas the other stocking material 22 is inserted over the lower nipping templates 44*c* and 50*c*. As shown in FIG. 3, the nipping templates travel in the direction G together with the carrier 31. During travel from the setting station I to the slicing station II, the solenoids 43 and 48 are energized in order to bring the three templates on each arm 40, 41 into neat pressure contact to each other, the thigh portions of the stocking materials 21 and 22 thereby being nipped in a superimposed disposition.

As the template assembly 30 holding the stocking materials 21 and 22 arrives at the slicing station II, the cutter device 60 is actuated to advance the cutter 61 into a space between the pair of template units, the nipped thigh portions of the stocking materials 21 and 22 thereby being sliced along the slicing line 25 shown in FIG. 2B.

After the slicing is complete, the template assembly 30 further travels towards the third station III. During this travel, the lower gear 56*a* on the carrier 31 comes into the running meshing engagement with the inside lower gear 58*a* on the guide rail 32 whereas the upper gear 57*b* on the carrier 31 comes into the running meshing engagement with the outside upper gear 59*b* on the guide rail 32. Thus, the template units open in almost straight alignment with each other and the sliced fringes 21*a* and 22*a* of the stocking materials 21 and 22 are exposed outside and assume an arched form.

Figure 15:
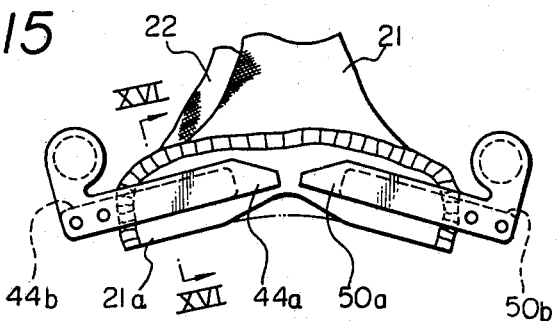
FIG. 15 is a plan view of the sliced fringes of the stocking materials in an outwardly exposed state effected by turning of the template units.
Figure 16:
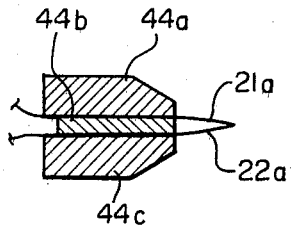
FIG. 16 is a section taken along lines XVI—XVI in FIG. 15, FIGS. 17A through 17D are schematic explanatory views for showing how the sliced fringes and the gore piece are guided through the station IV in FIG. 3.

This disposition is illustrated in FIGS. 15 and 16, in which the sliced fringe 21*a* of the stocking material 21 is nipped between the upper nipping templates 44*a*, 50*a* and the intermediate nipping templates 44*b*, 50*b* whereas the sliced fringe 22*a* of the stocking material 22 is nipped between the lower nipping plates 44*c*, 50*c* and the intermediate nipping templates 44*b*, 50*b*. Thus, as is clear in FIG. 16, the sliced fringes 21*a* and 22*a* are vertically spaced apart from each other by a distance equal to the thickness of the intermediate nipping templates 44*b* and 50*b*. Since the intermediate nipping templates 44*b* and 50*b* are smaller in length than the upper and lower nipping templates 44*a*, 44*c* and 50*a*, 50*c* and the sliced fringes 21*a* and 22*a* are especially stretched about the center portions thereof, the center portions of the sliced fringes 21*a* and 22*a* assume concave forms as shown in FIG. 15.

Figure 17A:
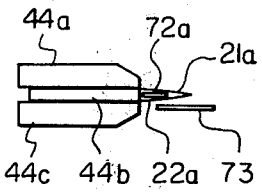

During travel of the template assembly 30 from the third station III to the first seaming station IV, the sliced fringes 21*a* and 22*a* are guided along the lower guide plate 73 until the position A in FIG. 8. Upon arrival at the position A, the front guide portion 72*a* of the upper guide plate 72 is located within the gap between the upper and lower sliced fringes 21*a* and 22*a* as shown in FIG. 17A.

Figure 17B:
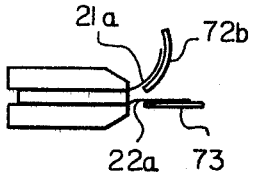

As the template assembly 30 further travels and arrives at the position B in FIG. 8, the upper and lower sliced fringes 21*a* and 22*a* are separated from each other as shown in FIG. 17B. The upper sliced fringe 21*a* is guided and folded upwardly by the larger guide portion 72*b* and the smaller guide portion 72*c*. On the other hand, the lower sliced fringe 22*a* is guided horizontally along the lower guide plate 73.

Figure 17C:
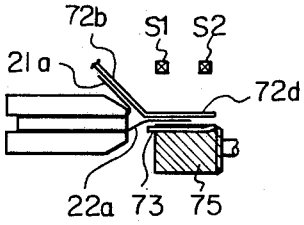
Figure 17D:
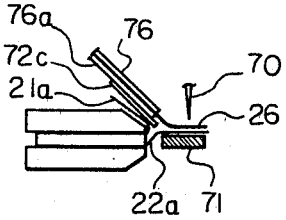

As described already, the rotary guide roller 75 is arranged at the downstream terminal end of the lower guide plate 73, i.e. the position C in FIG. 8. Thus, the sliced fringe 22*a* guided along the lower guide plate 73 is fed into the gap between the rear guide portion 72*d* of the upper guide plate 72 and the rotary roller 75 as shown in FIG. 17C and is further guided towards the seaming position on the first sewing machine 65 due to the rotation of the roller 75. Thus, at the first seaming station IV, only the lower sliced fringe 22*a* is seamed on the first sewing machine 65. During this seaming, the disc 76 holding the gore piece 26 is driven by the motor M2 for counterclockwise rotation as viewed in FIG. 6 in order to feed the gore piece 26 to the seaming position at the position D in FIG. 8, as shown in FIG. 17D. Then, one fringe of the gore piece 26 is seamed together with the center portion of the lower sliced fringe 22*a*. As the seaming goes on, the gore piece 26 is gradually stripped off the disc 76 and the disc 76 completes one cycle rotation when the seaming is over. Now, the disc 76 is ready for receipt of a new gore piece for the next cycle.

It should be noted that the concave form assumed by the center portion of the lower sliced fringe 22*a* normally will not meet the seaming line of the gore piece 26. In order to compensate for this the pair of sensors S1 and S2 are arranged upstreamly of the above-described roller 75 in order to detect presence of the lower sliced fringe 22*a*. When portions of the lower sliced fringe 22*a* are detected by the sensors 31 and 32, the angular relationship of the roller 75 with respect to the path of travel of the lower sliced fringe 22*a* is changed so that the concave center portion of the lower sliced fringe 22*a* will be pulled outsides and fed to the seaming position.

In more detail, as the lower sliced fringe 22*a* leaves the detectable area of the sensor S1, the sensor S1 is made conductive in order to drive the motor M4 for positive rotation. Thereupon, the levers 88 and 94 are turned in the direction N as viewed in FIG. 6 via the rotary disc 90 and the universal joint 92. This of the one lever 88 causes the L-shaped bracket 85 turn into similar direction about the vertical shaft 86 so that the roller 75 moves from the position shown with solid lines to that shown with dotted lines in FIG. 6. Concurrently, turning of the other lever 90 increases electric voltage to be applied to the motor M3 by the variable resistor 93 in order to raise rotation speed of the motor M3. This naturally gives rise to a quicker rotation of the roller 75 driven by the rotation control motor M3.

As the angular disposition of the roller 75 is changed, frictional contact between the roller 75 and the lower sliced fringe 22*a* pulls out the concave center portion of the latter into a direction shown by the arrow X in FIG. 8, and the lower sliced fringe 22*a* is passed to the seaming position on the first sewing machine 65 with this state being maintained. Since the rotation speed of the roller 75 is raised following the above-described change in the angular disposition, the lower sliced fringe 22*a* can be pulled out and fed to the seaming position in synchronism with the travelling speed of the nipping template assembly 30.

As presence of the outwardly pulled lower sliced fringe 22*a* is detected by the sensor S2, the roller 75 operates in the opposite manner. That is, as the outwardly pulled lower sliced fringe 22*a* moves into the detectable area of the sensor S2, the sensor S2 is rendered conductive while the sensor S1 is rendered nonconductive. Thereupon, the motor M4 reverses its direction of rotation. This negative rotation of the motor M4 causes the levers 88 and 94 to resume their initial dispositions, thereby returning the roller 75 to the initial position shown with solid lines in FIG. 6. The electric voltage applied by the variable resistor 93 to the rotation control motor M3 is lowered so that the rotation speed of the roller 75 is accordingly be lowered. Thus, the pulled out lower sliced fringe 22*a* is returned inwardly in order to leave or move out of the detectable area of the sensor S2. As the lower sliced fringe 22*a* moves out of the detectable area of the sensor S2, the latter is rendered nonconductive so that the roller 75 stops the returning movement and is maintained at this stop position.

Therefore, the roller 75 guides the lower sliced fringe 22*a* while maintaining this stop position. When any external force occasionally acts on the traveling lower sliced fringe 22*a* in order to stretch same and the stretched lower sliced fringe 22*a* moves out of the detectable area of the sensor S1, the latter is again rendered conductive and changes the angular posture of the roller 75 thereby pulling the lower sliced fringe 22*a* outwards. On the other hand, when the lower sliced fringe 22*a* is drawn into the detectable area of the sensor S2, the latter is again rendered conductive and causes the roller 75 at the stop position to further move towards the initial position in order to return the lower sliced fringe inwardly. Thus, the lower sliced fringe 22*a* is guided by the roller 75 through an area located intermediately of the detectable areas of the two sensors S1 and S2. Therefore, the concave curvature of the lower sliced fringe 22*a* is always converted into a constant straight form when guided towards the seaming position on the first sewing machine 65 so that seaming of the gore piece 26 to the lower sliced fringe 22*a* of the stocking material 22 can be carried out without any trouble.

Figure 18:
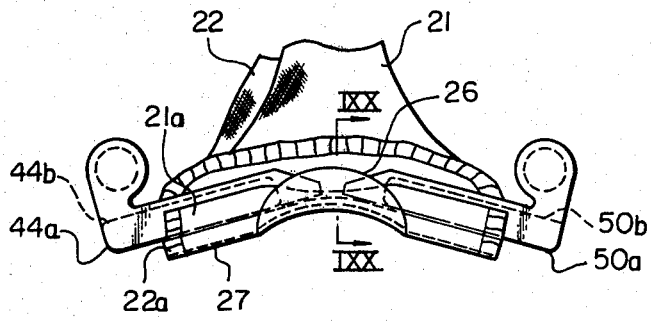
FIG. 18 is a plan view of the lower sliced fringe of the stocking materials seamed to one fringe of the gore piece on the first sewing machine.
Figure 19:
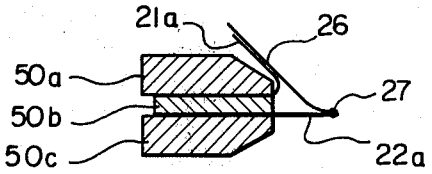
FIG. 19 is a section taken along lines IXX—IXX in FIG. 18, FIGS. 20A through 20D are schematic explanatory views for showing how the sliced fringes and the gore piece are guided through the station V in FIG. 3.

The seamed disposition of the gore piece 26 with the lower sliced fringe 22*a* of the stocking material 22 is shown in FIGS. 18 and 19, in which it is clear that the seaming line 27 extends over the entire length of the lower sliced fringe 22*a* and assumes a concave curvature at the position where the gore piece 26 is attached. As already explained, one fringe of the gore piece 26 is guided towards the seaming position on the first sewing machine 65 via rotation of the disc 76 while assuming an arched curvature, and the lower sliced fringe 22*a* is seamed to the gore piece 26 while being outwardly pulled. As a consequence, the seaming line 27 assumes the concave curvature of the stocking material 22 in the free state.

Figure 20A:
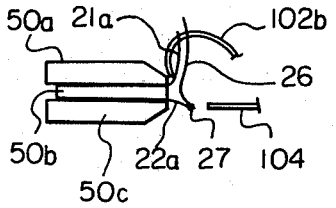
Figure 20B:
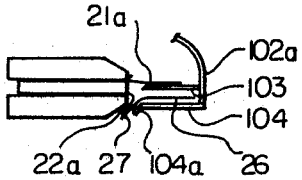

After the first seaming operation is over at the station IV, the template assembly 30 travels towards the second seaming station V. During this travel, the previously, upwardly folded upper sliced fringe 21*a* is returned to the initial horizontal position through engagement with the curved guide portion 102*b* of the upper guide plate 102 (see FIGS. 9 through 11) and guided along the top face of the intermediate guide plate 103. Concurrently, the lower sliced fringe 22*a* is guided in the horizontal state along the top face of the lower guide plate 104. When the portion of the lower sliced fringe 22*a* seamed to the gore piece 26 arrives at the position Q in FIG. 11 the gore piece 26 and the upper sliced fringe 21*a* are folded downwards due to engagement with the curved guide portion 102*b* of the upper guide plate 102 as shown in FIG. 20A. During the travel from the position Q to the postion R in FIG. 11, the folded gore piece 26 is guided in the horizontal state along the top face of the lower guide plate 104. Therefore, the center portion of the lower sliced fringe 22*a* seamed to the gore piece 26 is folded downwardly and guided along the inclined guide portion 104*a* of the lower guide plate 104.

Figure 11:
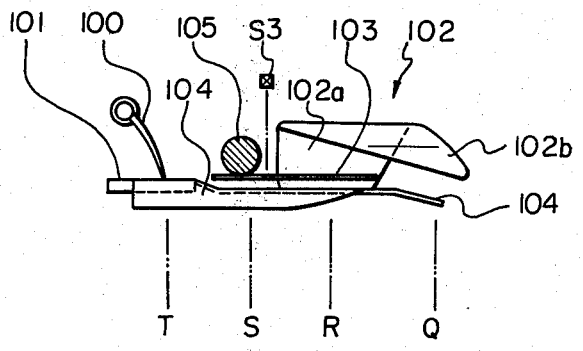
FIG. 11 is a partial view of the guide mechanism at the station V seen in the direction of an arrow XI in FIG. 9, FIGS. 12 and 13 are partial plan and side views for showing the relationship between the base carrying the second sewing machine and the seat therefore at the station V in FIG. 3.
Figure 20C:
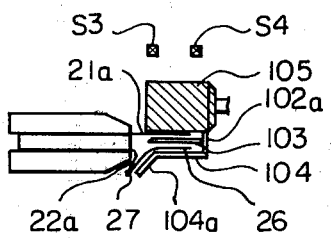
Figure 20D:
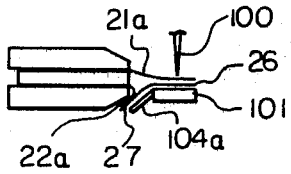

As described already, the guide roller 105 is located near the downstream terminal end of the the intermediate guide plate 103, i.e. at the position S in FIG. 11. The upper sliced fringe 21*a* moves into the gap between the intermediate guide plate 103 and the guide roller 105 as shown in FIG. 20C as same is guided along the top face of the guide plate 103. The upper sliced fringe 21*a* is then fed to the seaming position on the second sewing machine 66 via rotation of the guide roller 105.

The guide roller 105 is substantially the same as the guide roller 75 used in the preceding station IV in its construction and operation. Detection is carried out by the associated sensors S3 and S4. Since the center portion of the upper sliced fringe 21*a* also assumes a concave curvature just like the lower sliced fringe 22*a*, the concave center portion needs to be pulled outwardly for seaming to the gore piece 26 at the seaming position on the second sewing machine 66.

In more detail, the sensor S3 detects the absence of the upper sliced fringe 21*a* in the detectable area of the sensor S3 and drives the motor M6 for positive rotation. Thereupon, the levers 109 and 111 are turned into the direction P in FIG. 9 in order to displace the guide roller 105 from the position shown with solid lines to that shown with dotted lines. Concurrently, the rotation speed of the guide roller 105 is gradually escalated. Thus, the concave center portion of the upper sliced fringe 21*a* is pulled outwards due to frictional contact with the guide roller 105 on its travel towards the seaming position on the second sewing machine 66.

When the sensor S4 detects the presence of the upper sliced fringe 21*a*, the sensor S4 drives the motor M6 for negative rotation. The guide roller 105 starts to return towards the initial position with gradual lowering in the rotation speed, thereby returning the upper sliced fringe 21*a* inwards. Therefore, the upper sliced fringe 21*a* is always guided through an area located intermediately of the detectable areas of the two sensors S3 and S4 so that the upper sliced fringe 21*a* can be fed to the seaming position on the second sewing machine 66 in a straight form.

Upon arrival at the seaming position on the second sewing machine 66, the upper sliced fringe 21*a* is superposed on the lower sliced fringe 22*a* at the position T in FIG. 11 and the upper and lower sliced fringes 21*a* and 22*a* are seamed together by the second sewing machine 66. For seaming of the gore piece 26 with the upper sliced fringe 21*a*, the center portion of the lower sliced fringe 22*a* already seamed to the gore piece 26 is folded downwardly through engagement with the inclined guide portion 104*a* of the lower guide plate 104 so that the upper sliced fringe 21*a* is seamed to the gore piece 26 only in this portion. After seaming with the gore piece 26 is complete, the lower sliced fringe 21*a* is again guided along the top face of the lower guide plate 104 so that the upper and lower sliced fringes 21*a* and 22*a* are again superposed upon each other for seaming.

At seaming of the gore piece 26 to the upper sliced fringe 21*a*, the seat 124 (see FIG. 12) swings about the bracket 125 from the disposition A to that E in FIG. 14 while being driven by the cam 127. At the same time, the base 120 (see FIG. 12) swings about the shaft 123 from the disposition A to E in FIG. 14 while being driven by the cam 131. In more detail, when the cams 127 and 131 rotate over 90° from the initial angular position, the seat 124 and the base 120 remain fixed in their initial relationship. As the cams 127 and 131 further rotate from the angular position 90° to the angular position 270°, the seat 124 and the base 120 turn from the dispositions A to those E in different fashions. The seat 124 and the base 120 again remain fixed in their initial relationship as the cams 127 and 131 rotate from the angular position 270° to the angular position 360°.

By the above-described swing of the seat 124, the sewing needle 100 recedes from the template assembly 30 along the cam locus/27*a* in order to make the seaming line of the upper sliced fringe 21*a* with the gore piece 26 assume an arched form. The above-described swing of the base 120 changes the angular posture of the needle plate 101 of the second sewing machine so that the upper sliced fringe 21*a* and the one fringe of the gore piece 26 can both be guided in parallel to the longitudinal direction of the needle plate 101.

Figure 21:
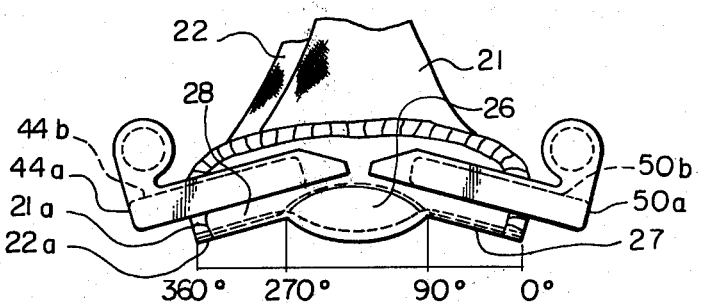
FIG. 21 is a plan view of the upper sliced fringe of the stocking materials seamed on the second sewing machine to the other fringe of the gore piece and to the lower sliced fringe of the stocking materials.

The seaming line 28 formed on the second sewing machine 66 is shown in FIG. 21, in which the seaming line 28 is composed of an initial straight seaming line which unites the upper and lower sliced fringes 21*a* and 22*a* together and extends inwardly of and parallelly to the seaming line 27, a convex seaming line which unites the center portion of the upper sliced fringe 21*a* with the one fringe of the gore piece 26, and a final straight seaming line which unites the upper and lower sliced fringes 21*a* and 22*a* together. The initial straight seaming line corresponds to rotation of the cams 127 and 131 from the angular position 0° to the angular position 90°, the convex seaming line corresponds to rotation of the cams 127 and 131 from the angular position 90° to the angular position 270°, and the final straight seaming line corresponds to rotation of the cams 127 and 131 from the angular position 127° to the angular position 360°.

Figure 22:
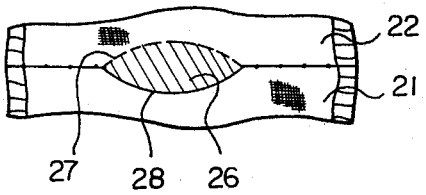
FIG. 22 is a partly spread view of the stocking materials to which the gore piece is completely seamed.

When the seaming line 28 is formed, a cutter (not shown) arranged near the needle plate 101 of the second sewing machine 66 cuts off the superfluous portions of the seaming line 27 and the gore piece 26. Thus, as shown in FIG. 22, the seaming line 28 is finally composed of an arched center seaming line which unites the upper sliced fringe 21*a* with the one fringe of the gore piece 26 and a pair of straight seaming lines on both sides of the center seaming line which unites the upper and lower sliced fringes 21*a* and 22*a* together. The seaming line 27 includes an arched center portion only which unites the lower sliced fringe 22*a* with the other fringe of the gore piece 26.

After the second seaming operation is completed on the second sewing machine 66, the template assembly 30 travels from the station V to the station VI. During this travel, the upper gear 57*a* on the carrier 31 (see FIG. 4) comes into meshing engagement with the inside upper gear 59*a* on the guide rail 32 and, likewise, the lower gear 56*b* on the carrier 31 comes into meshing engagement with the outside lower gear 58*b* on the guide rail 32. Thereupon, the arms 40 and 41 of the template assembly 30 turn towards each other in order to assume the initial disposition. Thereafter, the solenoids 43 and 48 are deenergized in order to liberate the nipping templates from the pressure contact. The completed panty-hose 20 is stripped off the template assembly 30 by the stripper mechanism 67 at the removing station VI and one cycle operation is completed. The template assembly 30 further travels towards the setting station I while being kept in a condition ready for the next cycle operation.

As is clear from the foregoing description, almost all of the operations can be carried out fully automatically and manual operation is required for the initial setting of the stocking materials only. The operator is required to stand near the setting station in order to practice the setting operation only. All the operations can be carried out at extremely high operation efficiency while assuring great savings in manual labour.

The first seaming is carried out while keeping the gore piece 26 in an arched state and the lower sliced fringe 22*a* in an outwardly pulled state into order to form a seaming line which assumes an inwardly arched curvature. The second seaming is carried out while keeping the upper sliced fringe 21*a* in an outwardly pulled state and the needle plate 101 in a receded state from the templates in order to form a seaming line which assumes an outwardly arched curvature. Thus, the obtained panty-hose is provided with a broad gore 26 attached to its thigh portion which enhances the commercial value of the product greatly.

During the second seaming operation, the upper sliced fringe 21*a* and the fringe of the gore piece 26 are guided in parallel to the longitudinal direction of the needle plate 101 by varying the angular posture of the latter. This prevents occurance of any twist and slippage of the fringe of the stocking material 21 and gore 26, thereby enabling smooth seaming operation.

Each template arm unit 40, 41 includes three sets of nipping templates 44*a-c*, 50*a-c* vertically spaced from each other and the intermediate nipping template 44*b* or 50*b* is smaller in length than the upper and lower nipping templates 44*a*, 44*c*, 50*a*, 50*c* so that same do not catch the center portions of the sliced fringe 21*a* or 22*a*. Thus, the sliced fringes 21*a*, 22*a* can be easily pulled outwards via frictional engagement with the guide roller 75 or 105. Thanks to the operation by the intermediate template 44*b* and 50*b*, the upper and lower sliced fringes 21*a* and 22*a* of the stocking materials 21 and 22 can be carried out quite easily and reliably.

I claim:

1. Improved seaming apparatus for gore panty-hoses comprising a circular guide rail having at least a setting station, a slicing station, a first seaming station, a second seaming station and a removing station for a pair of stocking materials, respectively, an annular carrier travelling along said guide rail, a plurality of template assemblies mounted on said carrier at prescribed intervals from each other and each having a pair of horizontally spaced turnable template units each of which has three sets of vertically superimposed nipping templates adapted for receiving said stocking materials at said setting station, means for placing said three nipping templates into neat pressure contact with each other in order to nip said stocking materials, a cutter device arranged at said slicing station and having a cutter which slices said stocking materials in the nipped disposition at a position intermediate of said pair of template units to the thigh portion in order to form upper and lower sliced fringes on said stocking materials, first means for turning said template units from a mutually parallel angular posture at said slicing station to a mutually aligned angular posture with free ends thereof confronting to each other in order to expose said upper and lower sliced fringes outside the interior of said stocking materials and make same assume a substantially straight form, a first sewing machine arranged at said first seaming station and having a first seaming position, first means arranged upstreamly of said first sewing machine and for guiding said lower sliced fringe towards said first seaming position while folding said upper sliced fringe slightly upwards, means accompanying said first guiding means and for feeding a rhombic gore piece towards said first seaming position, first means for adjusting the arched center portion of said lower sliced fringe to meet the corresponding one fringe of said gore piece in advance to seaming of said center portion to said one fringe by said first sewing machine, first means for detecting correct passage of said lower sliced fringe and generating a signal to be passed to said first adjusting means when said lower sliced fringe assumes incorrect path of travel.

a second sewing machine arranged at said second seaming station and having a second seaming position, second means arranged upstreamly of said second sewing machine and for guiding said upper sliced fringe towards said second seaming position after returning same to the horizontal state while folding said center portion of said lower sliced fringe downwards, second means for adjusting said upper sliced fringe to meet the other fringe of said gore piece in advance to seaming of said upper sliced fringe to said other fringe by said second sewing machine, second means for detecting correct passage of said upper sliced fringe and generating a signal to be passed to said second adjusting means when said upper sliced fringe assumes incorrect path of travel, and means for regulating the seaming line of said the other fringe of said gore piece with said upper sliced fringe to an arched form.

2. Improved seaming apparatus as claimed in claim 1 in which each of said template unit includes an upper nipping template, an intermediate nipping template and a lower nipping template, said intermediate nipping template being smaller in length than said upper and lower nipping templates.

3. Improved seaming apparatus as claimed in claim 1 in which said first guiding means include upper and lower guide plates, said upper guide plate having a horizontally extending front guide portion, an arched larger guide portion extending upwardly from said front guide portion, an arched smaller guide portion extending integrally and downstreamly of said larger guide portion, and a horizontal rear guide portion extending integrally of the lower end of said smaller guide portion, and said lower guide plate having a downwardly curved front guide portion and a horizontal rear guide portion extending integrally of said front guide portion.

4. Improved seaming apparatus as claimed in claim 3 in which said first adjusting means includes a rotation control motor operationally connected to said first detecting means, a guide roller mounted to the output shaft of said rotation control motor and arranged in contact with the bottom face of said rear guide portion of said upper guide plate, a reversible motor operationally connected to said first detecting means, and means for varying the angular posture of said guide roller with respect to path of travel of said lower sliced fringe in accordance with rotation of said reversible motor.

5. Improved seaming apparatus as claimed in claim 4 in which said first detecting means includes a pair of sensors arranged just upstreamly of said guide roller, laterally spaced on both sides of said path of travel of said lower sliced fringe, and controlling the operation of said reversible motor.

6. Improved seaming apparatus as claimed in claim 3 in which said gore piece feedng means includes a rotary feed disc whose degree of inclination is equal to those of said larger and smaller guide portions of said upper guide plate, the periphery of said feed disc being in local contact with said larger and smaller guide portions of said upper guide plate.

7. Improved seaming apparatus as claimed in claim 6 in which said feed disc is provided with a double layered construction and the lower half of the underside layer of said disc is openable.

8. Improved seaming apparatus as claimed in claim 1 in which said second guiding means includes an upper guide plate, an intermediate guide plate and a lower guide plate, said upper guide plate having a vertical guide portion and a curved guide portion extending downwards from the upper end of said vertical guide portion.

9. Improved seaming apparatus as claimed in claim 8 in which said second adjusting means include a rotation control motor operationally connected to said second detecting means, a guide roller mounted to the output shaft of said rotation control motor and arranged in contact with the bottom face of the downstream terminal of said intermediate guide roller, a reversible motor operationally connected to said second detecting means, and means for varying the angular posture of said guide roller with respect to path of travel of said upper sliced fringe in accordance with rotation of said reversible motor.

10. Improved seaming apparatus as claimed in claim 9 in which said second detecting means includes a pair of sensors arranged just upstreamly of said guide roller, laterally spaced on both sides of said path of travel of said upper sliced fringe, and controlling the operation of said reversible motor.

11. Improved seaming apparatus as claimed in claim 1 in which said regulating means includes a swingable seat, a base carrying said second sewing machine and swingably mounted on said seat, and means for swinging said seat and said base in different fashion from each other.

12. Improved seaming apparatus as claimed in claim 11 in which said swinging means includes a rotary shaft, a first cam mounted on said rotary shaft in peripheral contact with said seat, a second cam mounted on said rotary shaft in peripheral contact with said base, and means for holding said cams in resilient contact with said seat and said base, respectively.

* * * * *